US005617112A

United States Patent [19]

Yoshida et al.

[11] Patent Number: 5,617,112

[45] Date of Patent: Apr. 1, 1997

[54] DISPLAY CONTROL DEVICE FOR CONTROLLING BRIGHTNESS OF A DISPLAY INSTALLED IN A VEHICULAR CABIN

[75] Inventors: Toshio Yoshida; Michitaka Sisido, both of Tokyo, Japan

[73] Assignee: NEC Corporation, Tokyo, Japan

[21] Appl. No.: 360,958

[22] Filed: Dec. 21, 1994

[30] Foreign Application Priority Data

Dec. 28, 1993 [JP] Japan ..... 5-334558

[51] Int. Cl.[6] ..... G09G 3/36

[52] U.S. Cl. ..... 345/102; 345/147

[58] Field of Search ..... 345/63, 77, 87, 345/88, 102, 147, 207; 348/602, 673, 674, 687; H04N 5/57, 5/202, 5/14

[56] References Cited

U.S. PATENT DOCUMENTS

| | | | |
|---|---|---|---|
| 4,386,345 | 5/1983 | Narveson et al. | 345/207 |
| 4,514,727 | 4/1985 | Van Antwerp | 348/602 |
| 4,589,022 | 5/1986 | Prince et al. | 348/674 |
| 4,752,771 | 6/1988 | Katogi et al. | 345/88 |
| 4,760,389 | 7/1988 | Aoki et al. | 340/719 |
| 4,997,263 | 3/1991 | Cohen et al. | 345/207 |
| 5,347,293 | 9/1994 | Wiedemann | 345/87 |

FOREIGN PATENT DOCUMENTS

| | | |
|---|---|---|
| 0115575 | 8/1984 | European Pat. Off. . |
| 0145966 | 6/1985 | European Pat. Off. . |
| 0071343 | 6/1981 | Japan . |

*Primary Examiner*—Chanh Nguyen

*Attorney, Agent, or Firm*—Sughrue, Mion, Zinn, Macpeak & Seas

[57] ABSTRACT

When display control for a display device installed in a vehicular cabin is to be performed, an environmental light intensity is detected by a light sensor, and variation time function of the environmental light intensity is calculated. On the basis of the light intensity variation time function, a variation time function of a human pupil open degree is predicted. On the basis of the predicted time function, an optimal value of brightness of the display device is determined to perform display brightness control.

6 Claims, 6 Drawing Sheets

DISPLAY CONTROL DEVICE FOR CONTROLLING BRIGHTNESS OF A DISPLAY INSTALLED IN A VEHICULAR CABIN

BACKGROUND OF THE INVENTION

1. Field of the Invention

The present invention relates generally to a display device. More specifically, the invention relates to a display control device controlling brightness of display of various display equipments installed in a vehicular cabin.

2. Description of the Related Art

FIG. 7 is a block diagram of a mobile phone installed within a vehicular cabin as disclosed in Japanese Unexamined Patent Publication (Kokai) No. 56-71343. In FIG. 7 a brightness control line 10 is connected to a vehicular battery (not shown) via a lighting switch (not shown). When the lighting switch is turned ON, a battery voltage is applied to the brightness control line 10.

A microcomputer 8 is responsive to the battery voltage applied to the brightness control line 10 to control display of a display arrangement 9 via a display device drive circuit, and, in conjunction therewith, to perform lighting control for an illumination lamp 12 via a lamp driver circuit 13.

While the lighting switch is held OFF, the battery voltage is not applied to the brightness control line 10 and therefore, the display brightness of the display arrangement 9 is not controlled. Also, lighting control for the illumination lamp 12 is not performed.

In such conventional display equipments to be installed in the vehicular cabin, there is provided a manually operable dimmer circuit for controlling lighting intensity of the display arrangement, illumination lamp and further a back-light for display in association with the vehicular lighting switch or an automatic dimmer circuit for automatically controlling lighting intensity of the display arrangement or the back-light with taking a predetermined light intensity level as a threshold value.

In such conventional display control system, it has been difficult to assure good visibility in a wide brightness range from direct insolation of the sun beam to the dark. Also, the brightness control of the display equipment cannot satisfactorily follow the adaption of human pupil to abrupt variation of the light intensity at the entrance and exit of a tunnel.

SUMMARY OF THE INVENTION

Therefore, it is an object of the present invention to provide a display device which can detect variation in time and can automatically control light intensity of the display arrangement and back-light so as to adapt variation of the light intensity to adaption of opening degree of human pupil.

Another object of the present invention is to provide a display device which can assure good visibility in a wide range of light intensity from direct insolation of sun beam to the dark.

According to one aspect of the invention, a display device comprises:

display means for displaying character and/or graphic pattern;

light detecting means for detecting environmental light intensity of the display means and generating a detection signal depending upon the detected light intensity;

light intensity variation time function calculating means responsive to the detection signal for calculating a time function of variation of the light intensity;

display brightness determining means for determining a display brightness of the display means preliminarily set by predicting a time function of variation of a human pupil open degree corresponding to the derived light intensity variation time function; and display control means for performing brightness control of the display means according to the determined display brightness.

In the preferred construction, the display brightness determining means is a storage table storing display brightness information preliminarily determined by predicting the time function of variation of the human pupil open degree corresponding to the light intensity variation time function.

The display device may further comprises an analog-to-digital converting means for converting the detection signal into a digital signal then, the light intensity variation time function calculating means may have a time dependent variation information generating means for deriving a time dependent variation information indicative of variation of the digital signal in time responsive to variation of the detection signal, and the display brightness determining means may include a reference means for making reference to the storage table depending upon the time dependent variation information derived by the time dependent variation information generating means to take the result of making reference to the stage table as the display brightness information. Preferably, the storage table is a read-only memory taking the time dependent variation information as an address input and storing the display brightness information corresponding to respective addresses. In such case, it is preferred that the time dependent variation information is expressed by a given m bits of digital signal, the reference means takes an upper n bits, in which n is greater than zero and smaller than m, as the address input of the read-only memory, and the read-only memory stores $2^n$ of display brightness information respectively determined corresponding to address inputs with respect to $2^n$ of combination patterns of the upper n bits.

The display brightness determining means may also include a pupil open degree variation time function table set by preliminarily predicting time function of variation of human pupil open degree variation corresponding to the light intensity variation time function and a display brightness table preliminarily storing display brightness information indicative of optimal display brightness of the display means corresponding to the pupil open degree variation time function.

Similarly, the pupil open degree variation time function table may be a read-only memory taking the light intensity variation time function as address input and storing pupil open angle variation time functions respectively corresponding to the address inputs, and the display brightness table may also be a read-only memory taking the pupil open degree variation time function as an address input and storing the display brightness information corresponding to respective address inputs.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings

DESCRIPTION OF THE PREFERRED EMBODIMENT

The present invention will be discussed hereinafter in detail in terms of the preferred embodiments with reference to the drawings, particularly to FIGS. 1 to 6. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
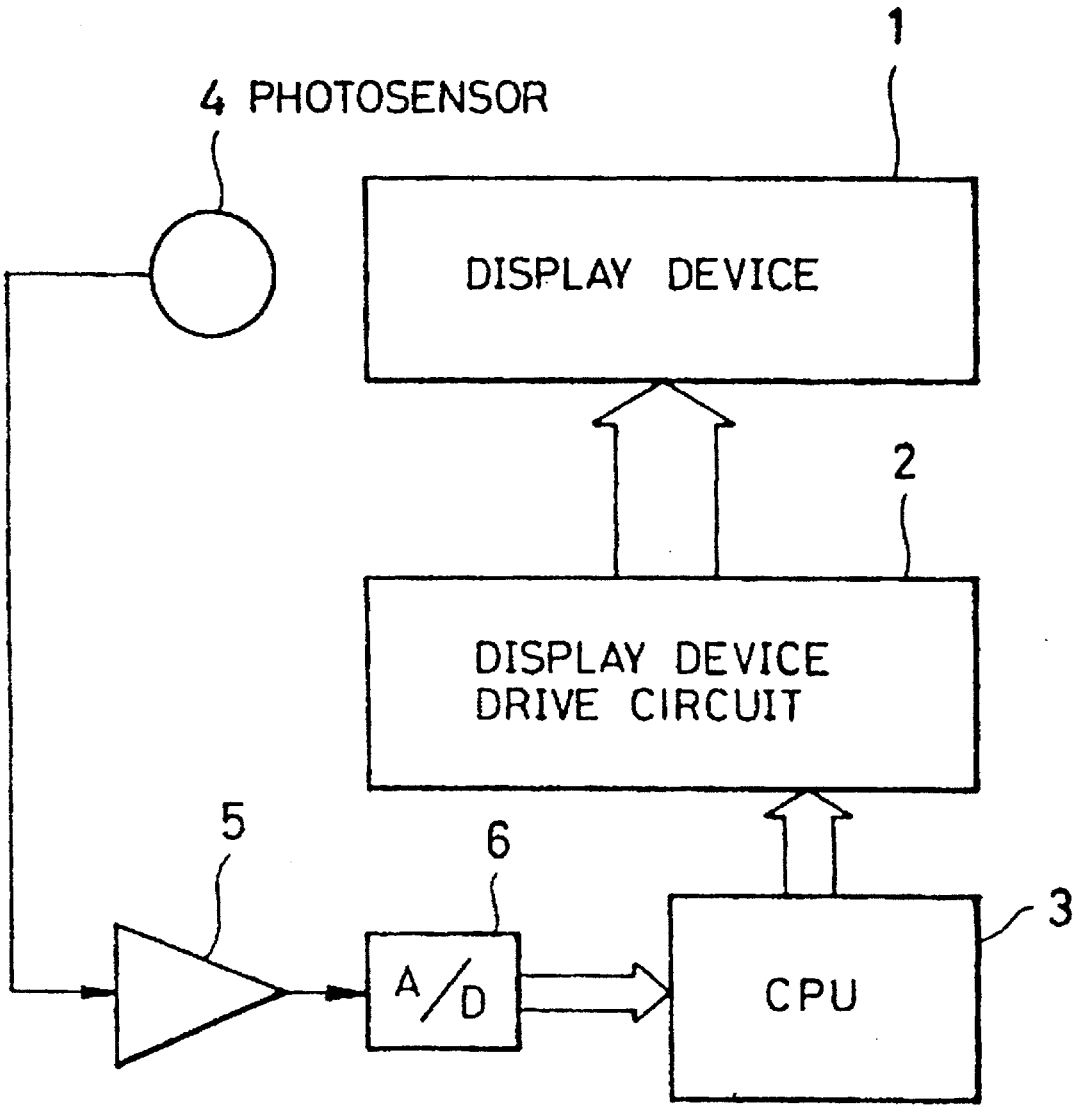
FIG. 1 is a schematic functional block diagram of the preferred embodiment of a display device according to the present invention.

FIG. 1 is a schematic block diagram showing one embodiment of a display device according to the present invention. A display device 1 is adapted to display characters, graphic patterns and so forth. As the display arrangement 1, a fluoroluminescent display device may be employed. A display device drive circuit 2 controls a brightness of display in the display device 1.

In order to detect an environmental light intensity, a photosensor 4 is provided. The photosensor 4 may comprise a phototransistor. The photosensor 4 is arranged in the vicinity of the display device 1 but will not be influenced by the light discharged from the display device 1. The photosensor 4 generates a light detection signal indicative of the environmental light intensity. The light detection signal of the photosensor 4 is amplified by an amplifier 5 to be elevated at a level where an analog-to-digital (A/D) converter 6 is operable.

A light detection information in a form of a digital signal as converted by the A/D converter 6 is supplied to a CPU 3. The CPU 3 processes the light detection information through a process illustrated in FIG. 2. By this process, a brightness of display of the display device 1 is optimally controlled depending upon the environmental light intensity.

Figure 2:
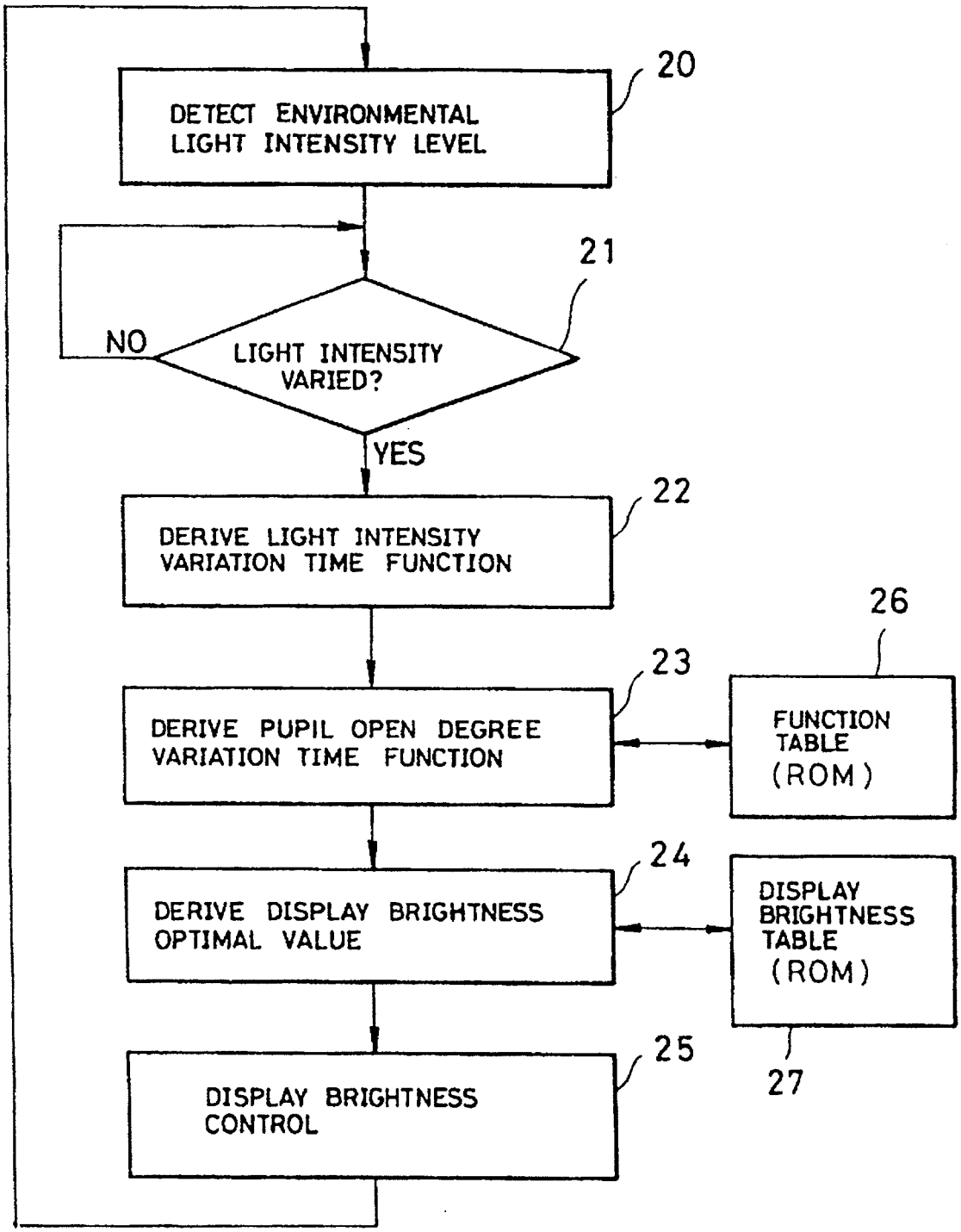
FIG. 2 is a flowchart showing operation of a CPU 3 in the block of FIG. 1.

Referring to FIG. 2, the photosensor 4 constantly detects the environmental light intensity to constantly supply the light detection signal to the CPU 3 via the amplifier 5 and the A/D converter 6 (step 20). Now, it is assumed that a vehicle enters into a tunnel, the light intensity is varied so that the light detection signal of the photosensor 4 is varied accordingly. Variation of the light intensity is output as variation of the light detection signal of the photosensor. The digital signal of the A/D converter 6 is varied accordingly.

When variation of the light intensity is detected (step 21), an absolute level of the environmental light intensity and a time function of the variation thereof are derived in response thereto (step 22). The time function of variation of the environmental light intensity may be calculated from the absolute level of the light intensity and a differentiated value thereof representative of variation thereof in time.

Corresponding to the time function of the light intensity variation, a time function of an open degree of human pupil can be determined in straightforward manner. Therefore the light intensity variation time function and the pupil open degree time function are stored in a function table 26 with correspondence in one to one manner. Then, on the basis of the light intensity variation time function derived at the step 22, the function table is made reference to read out the univocal corresponding pupil open degree time function to determine the pupil open degree time function (step 23).

Since the optimal brightness of the display device 1 is univocal determined corresponding to the pupil open degree time function, the pupil open degree time function and the optimal brightness are preliminarily set in a display brightness table 27 in one to one basis. Then, the display brightness table 27 is made reference to on the basis of the pupil open degree time function determined at the step 23, the optimal brightness univocal determined corresponding to the pupil open degree time function (step 24).

According to the optimal brightness thus determined, the CPU 3 controls brightness of the display device 1 via the display device drive circuit 2 (step 25).

Figure 3:
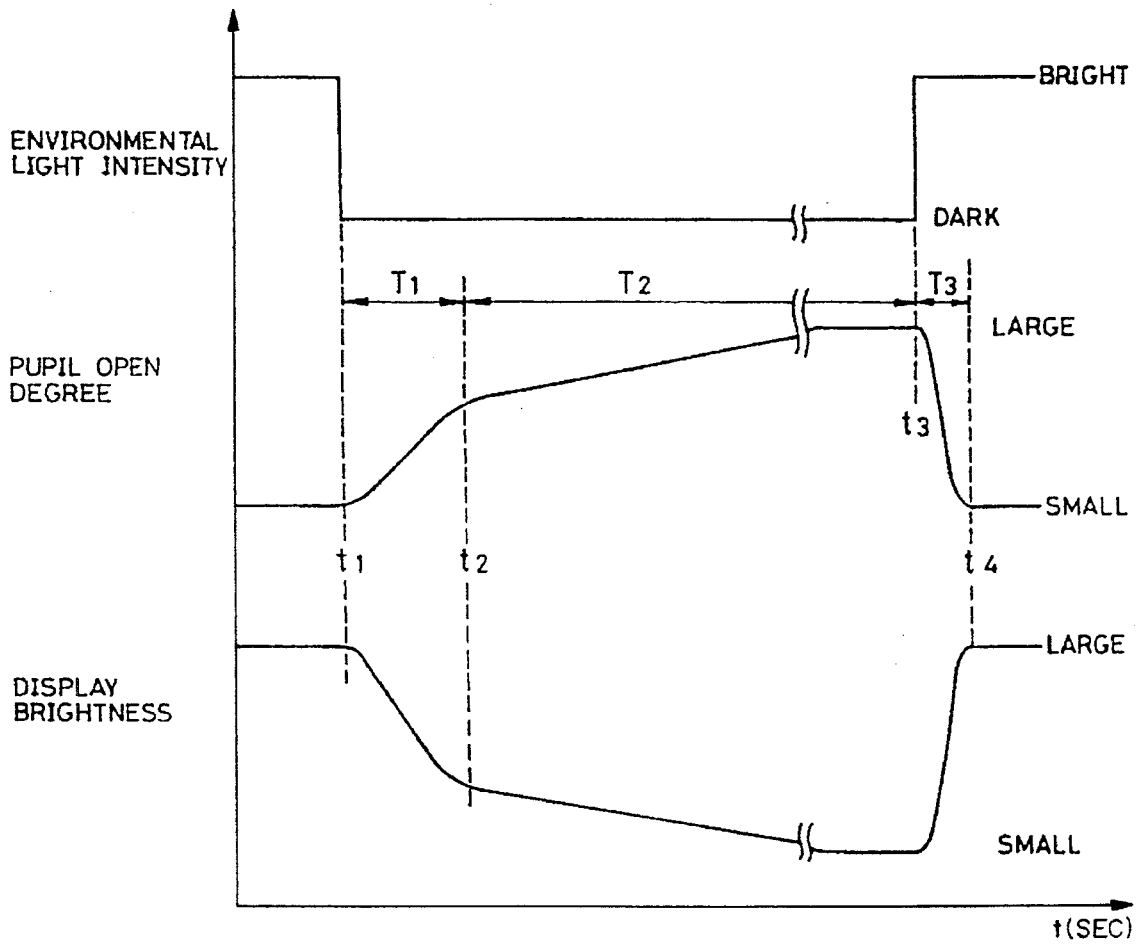
FIG. 3 is a chart showing variation of open degree of a human pupil in time in response to variation of environmental light intensity in time, and an example of control of a brightness of display in time in relation to variation of the open degree of the pupil in time.

FIG. 3 shows one example of variation of the light intensity in time and corresponding variation of the pupil open degree in time, and further shows optimizing control of the display brightness corresponding to variation of the pupil open degree in time.

Assuming that the vehicle enters into a tunnel from a bright area into a tunnel at a timing $t_1$, the environmental light intensity is abruptly varied from bright to dark. Within a few seconds from the timing $t_1$ to a timing $t_2$, the human pupil falls into dark change dazzlement state to abruptly open the pupil up to a certain open degree. Accordingly, during this period $T_1$, the display brightness of the display device 1 is abruptly reduced corresponding to abrupt opening of the pupil.

A period $T_2$ following the timing $t_2$ is a period, in which the human pupil moderately increase the open degree for adapting the human vision to the dark environment. During this period $T_2$, the display brightness is gradually reduced according to moderate increasing of the open degree of the human pupil.

At a timing $t_3$, the vehicle exits from the tunnel, the environmental light intensity is abruptly increased to be bright from dark. With a few seconds period $T_3$ between the timing $t_3$ to a timing $t_4$, the human pupil is in bright change dazzlement state. During this period, the human pupil abruptly decreases the open degree up to a certain open degree. Therefore, during this period $T_3$, the display brightness is abruptly increased according to closing state of the pupil.

In the human vision, it has been known that dark adaptation upon variation from bright environment to dark environment will take several minutes to several tens of minutes. Therefore, the brightness is optimally controlled moderately as shown in the period $T_2$ according to progress of dark adaptation. On the other hand, it is also known that light adaptation upon variation from dark environment to bright environment will take approximately one minute. Therefore, the brightness control corresponding to light adaptation is optimally performed more quickly than that corresponding to dark adaptation as shown in the period $T_3$.

Three variation characteristics (function) in time as illustrated in FIG. 3 are determined in univocal manner. Therefore, these characteristics are preliminarily stored in the function tables 26 and 27. In the function table 26, the time function of variation of pupil open degree with respect to the time function of variation of the light intensity is stored. On the other hand, in the display brightness table 27, the time function of variation of the optimal display brightness with respect to the time function of the variation of the open degree of the pupil is stored, These tables 26 and 27 may be stored in a read-only memory (ROM). For an address input of the table 26, the time function of variation of the light intensity is supplied. On the other hand, for the address input of the table 27, the time function of variation of the pupil open degree is supplied.

Manner of variation of the light intensity can be considered in wide variation other than that illustrated at that uppermost position in FIG. 3. In practice, it is not possible to completely adapt the brightness control for all of patterns of light intensity variation. Therefore, four to eight typical light intensity variation patterns, for example, are preliminarily determined. Then, with respect to these four to eight light intensity variation patterns, the time functions of pupil open degree variation is actually measured to store in the table 26. Also, with respect to the four to eight time functions of pupil open degree variation, the optimal values of display brightness of the display device is actually measured and stored in the table 27.

When the light intensity variation patterns are set at four to eight typical patterns as set forth above, the manner of discriminating the light intensity variation pattern with respect to the set four to eight patterns is as follows.

Namely, for deriving the time function of the light intensity variation (step 22), it is derived on the basis of the absolute level of the light intensity and the variation amount in time (differentiated value). When the time function of the light intensity variation is expressed by m bits, combination of upper n ($0<n<m$) bits in the m bits is used to formulate $2^n$ (when n=2 to 3, 4 to 8 patterns) bit patterns to be used as address input for the function table 26.

Figure 4:
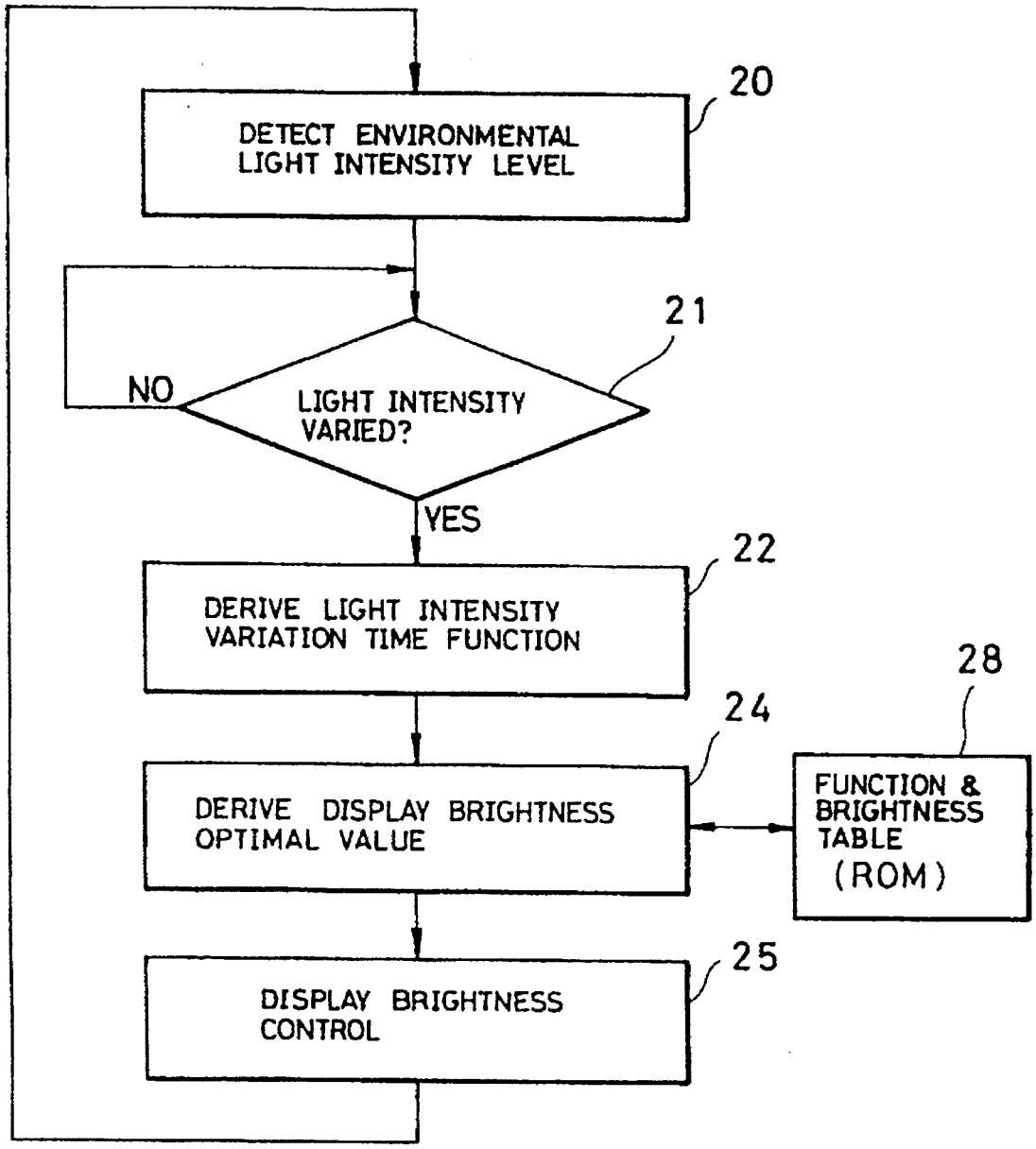
FIG. 4 is a flowchart showing another operation of the CPU 3 in the block of FIG. 1.

While the optimal display brightness is determined utilizing the function table 26 and the display brightness table 27 in the example of FIG. 2, it may be possible to aggregate both tables into a single table. FIG. 4 shows an embodiment employing a single table 28.

In the embodiment of FIG. 4, the step 23 in FIG.2 for determining the time function of the pupil open degree variation is neglected, and instead, the display brightness information in relation to the time function of the light intensity variation is preliminarily stored in the table 28. In this case, the display brightness stored in the table 28 is the optimal value set by preliminarily predicting the time function of variation of the pupil open degree corresponding to the time function of the light intensity variation.

Even in this example, the table 28 may be set in the read-only memory. Also, the light intensity variation patterns are classified into four to eight typical patterns, and the optimal display brightness information respectively corresponding to the set four to eight light intensity variation patterns are stored in the ROM through actual measurement, similarly to the embodiment of FIG. 2.

Figure 5:
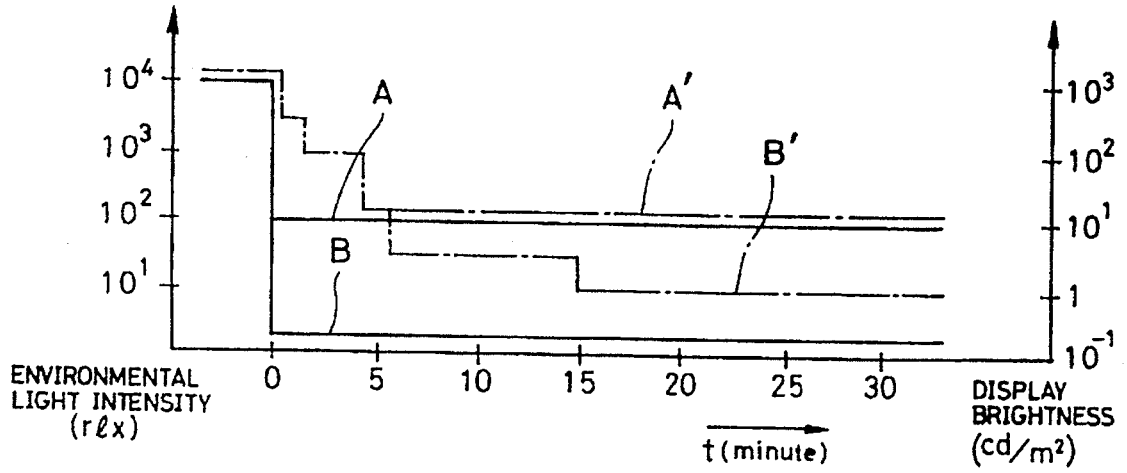
FIGS. 5 and 6 are illustration showing examples of variation of the environmental light intensity and examples of control of brightness for display corresponding thereto.
Figure 6:
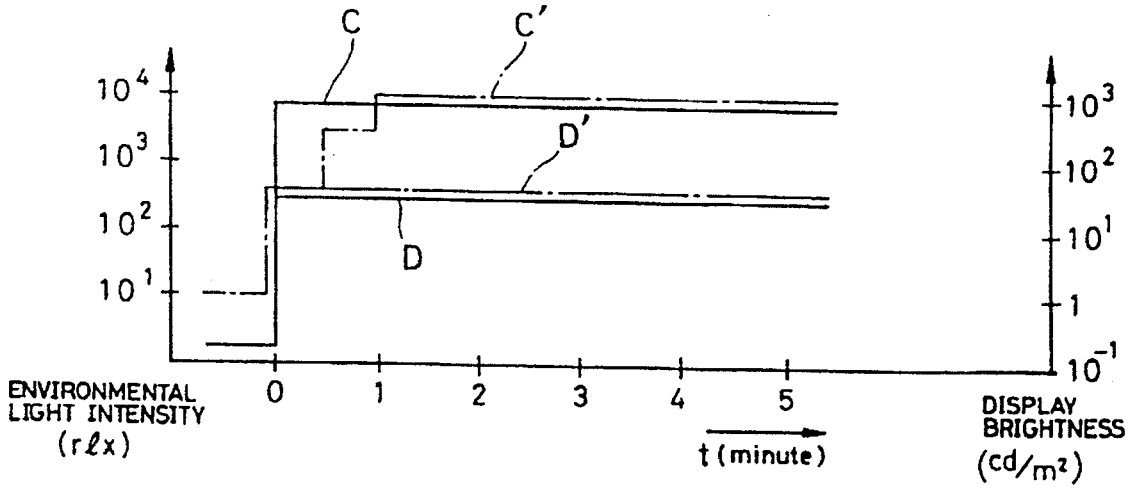
Figure 7:
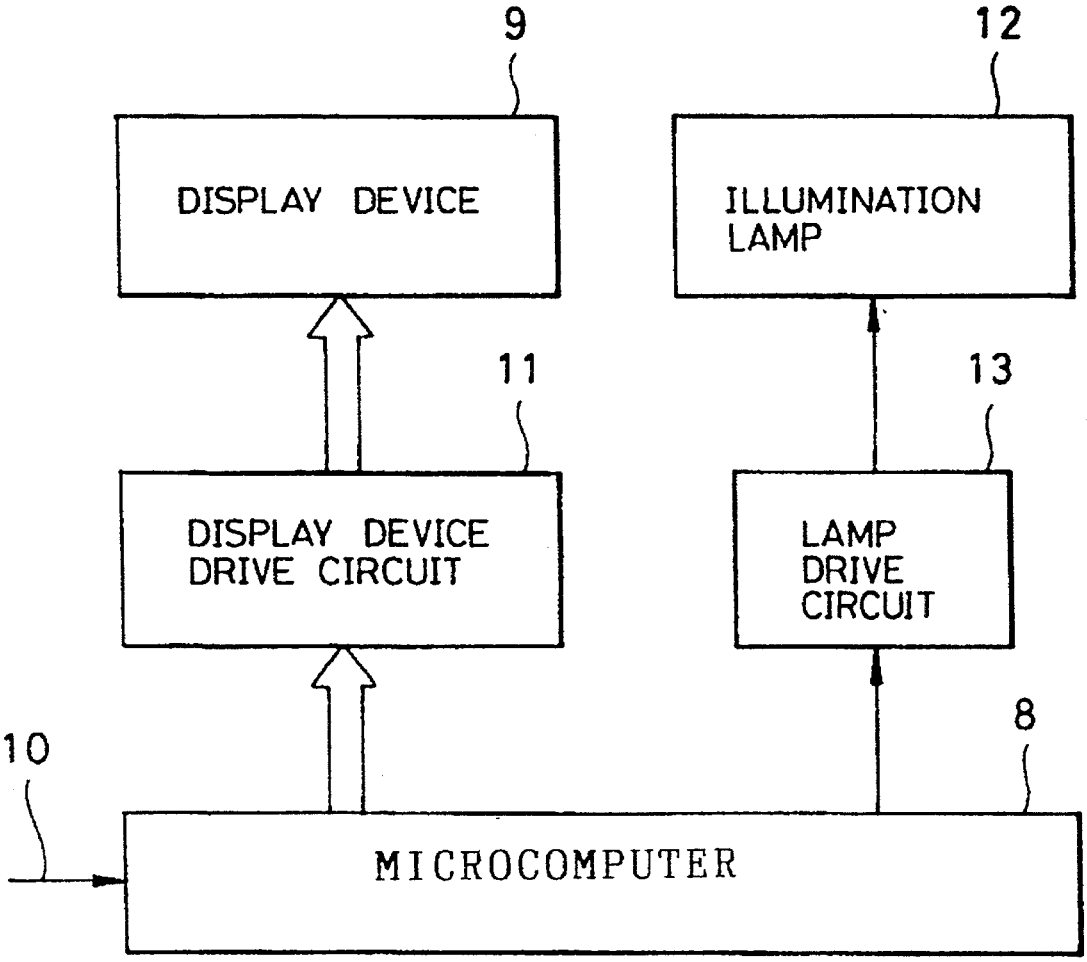
FIG. 7 (PRIOR ART)
FIG. 7 is a block diagram showing an example of a conventional display control of a display equipment in a vehicular cabin.

It should be noted that, FIGS. 5 and 6 shows actual examples of display brightness control A', B', C', D' with respect to environmental light intensity variation A, B, C, D. FIG. 5 shows the examples of dark adaptation control in the case where the environmental light intensity is varied from bright to dark abruptly with respect to the examples A and B. In practice, with respect to each of the examples A and B of the environmental light intensity variation, the display brightness is controlled in according to an elapsed time in stepwise fashion as illustrated by A' and B' approximating the human dark adaptation characteristics.

FIG. 6 shows the examples of light adaptation control in the case where the environmental light intensity is varied from dark to bright abruptly, with respect to the examples of C and D. In practice, with respect to each of the examples C and D of the environmental light intensity variation, the display brightness is controlled in according to an elapsed time in stepwise fashion as illustrated by C' and D' approximating the human light adaptation characteristics.

As set forth above, according to the present invention, even when the light intensity in the vehicular cabin is varied, good visibility is certainly obtained so as not to cause trouble in driving of the vehicle. Therefore, upon entering into the tunnel in driving under daylight or at the transition from brightly lighted zone to the dark zone in the night, the display brightness can be smoothly varied according to adjusting period of the human pupil. Therefore, it becomes possible to avoid temporary dazzlement or dazing due to excessive display brightness.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A display device, comprising:

display means for displaying a character and/or graphic pattern;

light detecting means for detecting an environmental light intensity and generating a detection signal depending upon the detected light intensity;

light intensity variation time function calculating means responsive to said detection signal for calculating a time function of variation of the light intensity:

display brightness determining means for determining a display brightness of said display means preliminary set by predicting a time function of variation of a human pupil open degree corresponding to the derived light intensity variation time function; and display control means for performing brightness control of said display means according to the determined display brightness, wherein said display brightness determining means includes a pupil open degree variation time function table set by preliminarily predicting time function of variation of human pupil open degree variation corresponding to said light intensity variation time function and a display brightness table preliminarily storing display brightness information indicative of optimal display brightness of said display means corresponding to said pupil open degree variation time function.

2. A display device as set forth in claim 1, wherein said pupil open degree variation time function table is a read-only memory taking said light intensity variation time function as address input and storing pupil open degree variation time functions respectively corresponding to the address inputs.

3. A display device as set forth in claim 2, wherein said display brightness table is a read-only memory taking the pupil open degree variation time function as an address input and storing said display brightness information corresponding to respective address inputs.

4. A method of controlling the brightness of a display, the method comprising the steps of:

displaying a character and/or graphic pattern on said display;

detecting an environmental light intensity and generating a detection signal depending upon the detected light intensity;

calculating a time function of variation of the light intensity in response to said detection signal;

determining, in response to said time function of variation of the light intensity, a display brightness of said display in accordance with a time function of variation of a human pupil open degree; and performing brightness control of said display according to the determined display brightness;

wherein said determining step includes:

preliminarily setting a pupil open degree variation time function table by predicting a time function of variation of human pupil open degree variation corresponding to said light intensity variation time function; and preliminarily storing, in a display brightness table, display brightness information indicative of optimal display brightness of said display means corresponding to said pupil open degree variation time function.

5. The method according to claim 4, wherein said pupil open degree variation time function table is a read-only memory, and wherein said determining step includes:

using said light intensity variation time function as an address input; and storing pupil open degree variation time functions respectively corresponding to the address inputs.

6. The method according to claim 5, wherein said display brightness table is a read-only memory, and wherein said determining step includes:

using the pupil open degree variation time function as an address input; and storing said display brightness information corresponding to respective address inputs.

* * * * *